US005197664A

United States Patent [19]

Lynch

[11] Patent Number: 5,197,664

[45] Date of Patent: Mar. 30, 1993

[54] METHOD AND APPARATUS FOR REDUCING THERMAL STRESS ON HEAT EXCHANGERS

[75] Inventor: Gregory A. Lynch, Murfreesboro, Tenn.

[73] Assignee: Inter-City Products Corporation (USA), LaVergne, Tenn.

[21] Appl. No.: 784,770

[22] Filed: Oct. 30, 1991

[51] Int. Cl.[5] ..... F23N 5/00

[52] U.S. Cl. ..... 236/11; 236/94; 431/6; 431/18; 126/116 A

[58] Field of Search ..... 236/11, 94; 431/2, 6, 431/18, 73; 165/13, 32; 126/94 R, 110 R, 110 A, 116 A

[56] References Cited

U.S. PATENT DOCUMENTS

| | | | |
|---|---|---|---|
| 4,502,625 | 3/1985 | Mueller | 236/11 |
| 4,706,881 | 11/1987 | Ballard | 236/15 |
| 4,773,586 | 9/1988 | Ryan | 236/11 |
| 4,792,089 | 12/1988 | Ballard | 236/11 |
| 4,887,767 | 12/1989 | Thompson et al. | 236/1 |
| 4,907,737 | 3/1990 | Williams, Jr. | 236/11 |
| 4,982,721 | 1/1991 | Lynch | 126/116 |
| 5,027,789 | 7/1991 | Lynch | 126/16 A |

*Primary Examiner*—John Sollecito
*Attorney, Agent, or Firm*—Baker & Daniels

[57] ABSTRACT

The present invention is a furnace control system responsive to a circulator fan motor fault condition. Upon detection of the fault, the control determines a first time period which is required to activate the temperature limit switch of the furnace by continuous operation of the gas burner and a second time period which is required for the plenum to dissipate sufficient heat to deactivate the temperature limit switch. After determining the first and second time periods, the furnace control operates the burners for a fraction of the first time period and then allows the heat exchangers to cool for the second time period until the circulator fan motor fault is corrected or the demand for heat ceases.

24 Claims, 4 Drawing Sheets

METHOD AND APPARATUS FOR REDUCING THERMAL STRESS ON HEAT EXCHANGERS

BACKGROUND OF THE INVENTION

1. Field of the Invention

The present invention relates to furnaces. More specifically, the field of the invention is that of furnaces having control circuitry responsive to fault conditions which tend to stress the furnace heat exchangers.

2. Prior Art

Conventional furnaces include fans for circulating air about a heated plenum. For example, gas burners may be used to heat a heat exchanger which defines internal and external fluid passages. One fan, typically an inducer fan, circulates combustion air inside the heat exchanger for warming the body of the heat exchanger. Another fan, a circulator fan, causes the indoor air to circulate about the external surfaces of the heat exchanger so that the indoor air is warmed by contact with the heat exchanger body.

Conventional furnaces also include a thermostatic control having a temperature sensing element in thermal contact with the indoor air to determine if the indoor air requires heat. The furnace control activates the gas burners of the plenum and operates the fans according to signals from the temperature sensing element. A further feature of conventional furnace control circuitry involves additional temperature sensing elements which are disposed in thermal contact with the plenum to determine if the gas burners and the fans are operating properly. For example, a thermostatic control may include a high limit temperature sensing element or switch disposed in thermal contact with the plenum to determine if the plenum is too hot.

An example of such a conventional thermostatic control is disclosed in U.S. Pat. Nos. 4,976,459, 4,982,721, and 5,027,789, assigned to the assignee of the present invention, the disclosures of which are explicitly incorporated by reference. In the thermostatic control disclosed in the aforementioned U.S. Patents, a circulator motor fault signal is provided to the furnace control which indicates if the circulator fan is operative. In the case of an inoperative circulator fan which may be caused by motor or drive system failure, the control causes a flashing signal to appear on the control so that service personnel may easily determine the fault condition.

However, the failure of the circulator fan motor may have adverse consequences for the heat exchanger. Programming in the control circuitry halts normal operation of the furnace when the high limit switch indicates that the plenum is too hot. In the case of a circulator fan fault condition, the circulator fan is unable to circulate indoor air about the heat exchangers, causing the temperature of the plenum and particularly of the heat exchangers to increase. Eventually, the plenum temperature increases sufficiently to cause the high limit switch to open which then shuts down operation of the furnace. A potential problem with this conventional arrangement involves the rapid variations in temperature of the heat exchangers.

When the furnace first starts to heat, the heat exchangers initially have their temperatures increased rapidly and are thus quickly brought up to operating temperature. In the case of a circulator fan fault condition, the circulator fan does not cause air to flow over the heat exchangers, thus the heat exchangers are heated until the plenum is such a high temperature that the high limit switch is activated and the gas valve is turned off. The heat exchangers are then allowed to cool until the high limit switch is deactivated by heat dissipation within the building. The furnace goes through a ramping heat/cooling cycle repeatedly while the circulator fan is inoperative. This repetitive ramping heating/cooling cycle allows for some heated air to reach the interior of the building being heated, although much less than would reach the building interior with an operative circulator fan.

One problem with this sequence of operations involves the effect of the ramping heat/cooling cycle on the heat exchangers. Heat exchangers are conventionally designed to expand and contract because of the active and inactive periods of the furnace. However, when constantly expanding and contracting during a circulator fan fault condition, heat exchangers are subject to maximum thermal stress which fatigues the heat exchangers and shortens their useful life. For example, such heating and cooling may fatigue the sealing of clam-shell heat exchangers and prematurely separate the halves which define the interior combustion air passage. Another problem involves corrosion of the heat exchangers, which may be facilitated by additional condensate which periodically forms during the heat/cooling cycle.

What is needed is a thermostatic control which responds to a circulator fan fault condition.

A further need is a thermostatic control which minimizes the thermal stress on the heat exchangers during a circulator fan fault condition.

SUMMARY OF THE INVENTION

The present invention is a method of operating a furnace which allows the furnace to provide a limited amount of heat when the circulator fan is inoperative, while minimizing the thermal stress on the heat exchangers. The present invention controls the furnace so that the burners are operated for only a fraction of the ramping time, and the heat exchangers are allowed to cool for a second predetermined time before restarting the burners. In this manner, the gas burners may provide some indoor heating without the circulator fan operating, but the heat exchangers are not subject to constant extreme temperature ramping.

The control of the furnace includes a timer which determines the amount of time necessary for the burner to operate and activate the high limit switch. Also, the timer determines the amount of time the burner is inactive before the high limit switch returns to its inactivated position. After determining these burner-on and burner-off times, the burners are operated for a fraction of the burner-on time, for example, eighty percent (80%), and left inoperative for the burner-off time as long as a demand for heat exists.

The present invention is, in one form, a furnace comprising a plenum, a circulator fan, and a control device. The plenum includes a heat exchanger and a burner for heating the heat exchanger. The circulator fan circulates indoor air about the heat exchanger, and is in communication with the plenum. Also, the circulator fan includes a fault detector for indicating the occurrence of a circulator motor fault condition. The control device is for activating and deactivating the burner, and operates the burner for a first time period then disables the burner for a second time period when the fault detector indicates the occurrence of a circulator motor fault condition. Upon indication of the circulator motor fault condition by the fault detector, the control device alternately operates and disables the burner.

One object of the present invention is to provide a thermostatic control which responds to a circulator fan fault condition.

A further object is to provide a thermostatic control which minimizes the thermal stress on the heat exchangers during a circulator fan fault condition.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplifications are not to be construed as limiting the scope of the invention in any manner.

DESCRIPTION OF THE PREFERRED EMBODIMENT

Figure 1:
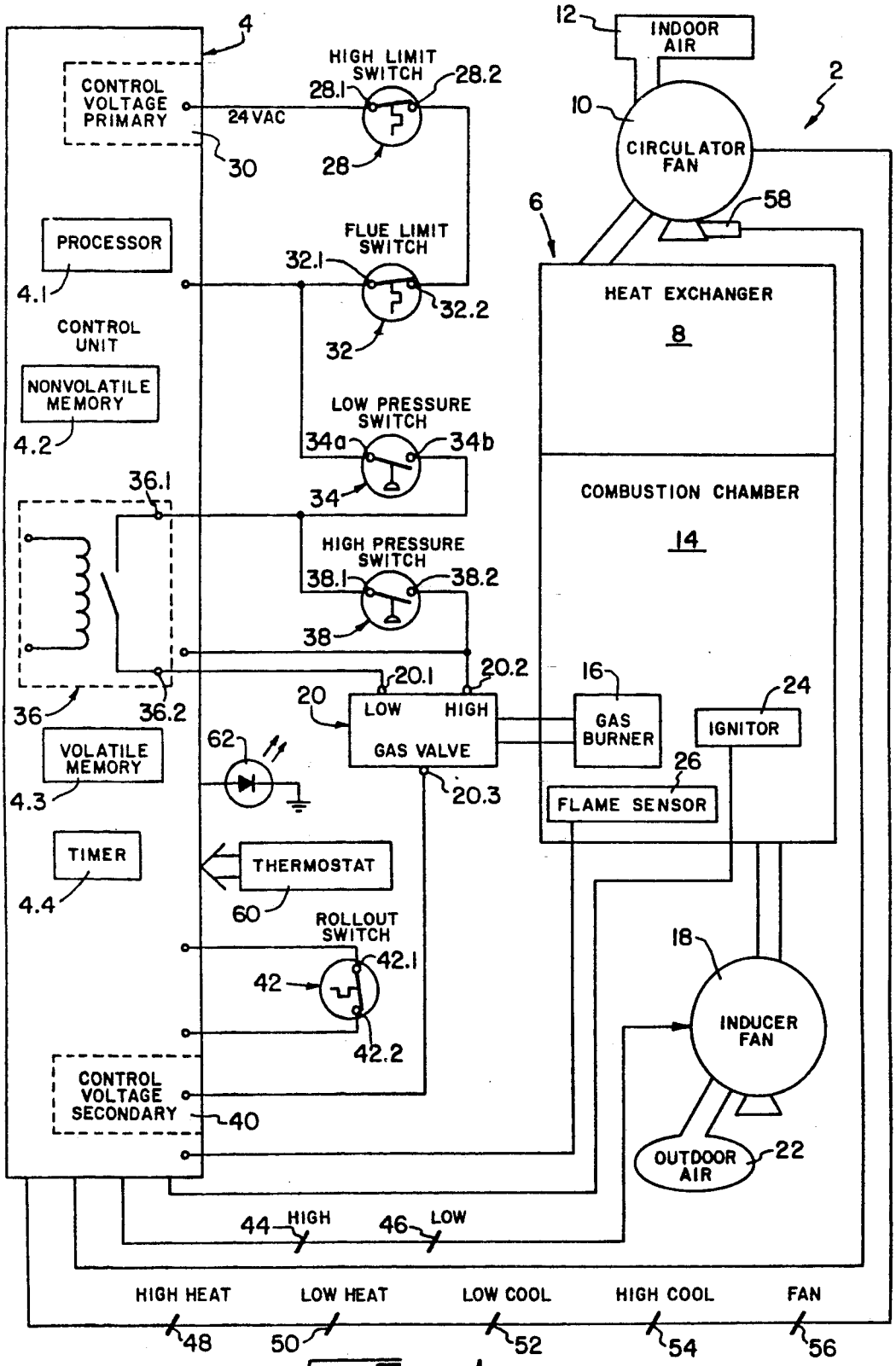
FIG. 1 is a schematic diagram of the furnace of the present invention.

The present invention relates to a two stage furnace 2 as shown in FIG. 1. The present invention is particularly concerned with control unit 4 which includes a processor 4.1, nonvolatile memory 4.2 for permanently storing programming, volatile memory 4.3 for dynamically storing program variables, a timer 4.4, and other circuitry as described below. Non-volatile memory 4.2 may be programmable read-only memory (PROM), electrically programmable read-only memory (EPROM), electrically erasable programmable read-only memory (EEPROM) or the like; and volatile memory 4.3 may be random access memory (RAM) or the like. Timer 4.4 may be a clock in which timing is determined by observation of the current state of timer 4.4 at different points in its operation and performing the necessary arithmetic operations to determine the amount of time elapsed. Alternatively, timer 4.4 may be an interrupting device which may count up or count down. However, the invention encompasses other arrangements of control circuitry which control operation of a single stage or a two stage furnace.

Control unit 4 operates in conjunction with plenum 6 of furnace 2. Plenum 6 includes a heat exchanger portion 8 which has at least one heat exchanger (not shown) and ducts (not shown) in communication with circulator fan 10. Indoor air 12 is heated by circulator fan 10 circulating air through heat exchanger portion 8 and back into a building (not shown). Circulator fan 10 should have at least two speed settings, one for a first stage of heat and one for a second stage of heat. In the exemplary embodiment, circulator fan 10 includes a brushless, permanent magnet (BPM) motor which is variable in speed and has 10 speed taps. However, circulator fan 10 may have more speed settings as desired for the particular application. Circulator fan 10 includes two heat speed settings, one for high heat and one for low heat. The BPM motor maintains a constant torque to compensate for changes in static pressure. Circulator fan 10 requires approximately 15 to 20 seconds to change its speed after its speed setting is changed, which reduces the noise. In addition, speeds for a fan only or a cool cycle may be included.

Combustion chamber 14 supplies heat by means of gas burner 16 and inducer fan 18, and thermally contacts heat exchanger portion 8. Gas burner 16 receives combustion fluid (e.g., natural gas or propane) from gas valve 20 and outdoor air 22 from inducer fan 18, and combines the fluids to produce a combustion mixture which burns to warm heat exchanger portion 8. Inducer fan 18 comprises a two speed motor for running at either high heat speed or low heat speed setting. Gas valve 20 has a low terminal 20.1 and a high terminal 20.2 for activating a low heat level and a high heat level of combustion. Combustion chamber 14 further includes a hot surface ignitor 24 for initiating combustion, and flame sensor 26 for detecting a flame at gas burner 16. Flame sensor 26 is positioned in the path of the flame from gas burner 16.

The heat speed settings of circulator fan 10 are adapted to match the settings of inducer fan 18 and gas valve 20. Similarly, inducer fan 18 is adapted to provide sufficient air for the amount of fuel supplied by gas valve 20. Thus, when gas valve 20 is set on low for low heat, inducer fan 18 runs on low to provide an adequate combustion mixture and circulator fan 10 runs on low to extract substantially all the heat produced. When gas valve 20 is set on high for high heat, inducer fan 18 runs on high to provide an adequate combustion mixture and circulator fan 10 runs on high to extract substantially all the heat produced. During most conditions, the setting of circulator fan 10, inducer fan 18, and gas valve 20 match. However, at certain points in the operation of furnace 2 the settings may not match, as described more particularly in the aforementioned U.S. Pat. Nos. 4,976,459, 4,982,721, and 5,027,789.

Also, pressure and temperature switches are present in plenum 6 and are described below, although the switches are shown separately for clarity. High limit switch 28 is in thermal communication with heat exchanger portion 8 for detecting when the temperature exceeds a predetermined limit. Under normal operating conditions high limit switch 28 is closed, however, when the temperature of heat exchanger portion 8 rises to a predetermined level such that the heated conditioned air exceeds a certain level, for example 185° F., high limit switch 28 opens. Terminal 28.1 of high limit switch 28 is coupled to control voltage primary 30, which supplies power to gas valve 20. Terminal 28.2 of high limit switch 28 is coupled to terminal 32.2 of flue limit switch 32.

Flue limit switch 32 is in thermal communication with combustion chamber 14 and operates similarly to high limit switch 28. However, flue limit switch 32 reacts to temperature sensed from the flue gases, and opens when the temperature of the flue gases rises to a predetermined level, for example 130° F. Terminal 32.1 of flue limit switch 32 has a return to control unit 4, so that control unit 4 can test the circuit including high limit and flue limit switches 28 and 32 to determine if at least one of the two has opened. Terminal 32.1 of flue limit switch 32 is also coupled to terminal 34.1 of low pressure switch 34.

Low pressure switch 34 is located in communication with combustion chamber 14 for determining if sufficient outside air 22 is being provided for a low heat level of combustion, or low combustion. When inducer fan 18 is not running, low pressure switch 34 is open. Low pressure switch 34 closes when a predetermined pressure occurs in combustion chamber 14. The predetermined pressure for closing low pressure switch 34 corresponds to a pressure that allows sufficient outdoor air 22 to support low combustion, which varies for the size and arrangement of a particular furnace. Both terminals 34.1 and 34.2 of low pressure switch 34 are coupled to control unit 4 so that switch 34 can be directly tested.

Terminal 34.2 of low pressure switch 34 is coupled to terminal 36.1 of relay switch 36 and terminal 38.1 of high pressure switch 38. Relay switch 36 can be any suitable interrupting switching device. Terminal 36.2 of relay switch 36 is coupled to low terminal 20.1 of gas valve 20 so that control unit 4 can turn on the low heat level of gas flow. When switches 28, 32, and 34 are closed and control unit 4 closes relay switch 36, a closed circuit is formed from control voltage primary 30 to low terminal 20.1 of gas valve 20, which also has return terminal 20.3 coupled to control voltage secondary 40. Control voltage secondary 40 is the return of control voltage primary 30, which in the exemplary embodiment provides a 24 volt alternating current (24 VAC) for energizing gas valve 20. The same circuit that energizes low terminal 20.1 of gas valve 20 also controls the redundant stage of gas valve 20.

High pressure switch 38 is located in communication with combustion chamber 14 for determining if sufficient outside air 22 is being provided for a high heat level of combustion, or high combustion. When inducer fan 18 is not running on high heat speed, high pressure switch 38 is normally open. High pressure switch 38 closes when a predetermined pressure occurs in combustion chamber 14. The predetermined pressure for closing high pressure switch 28 corresponds to a pressure that allows sufficient outdoor air 22 to support high combustion, which varies for the particular size and arrangement of a particular furnace. Both terminals 38.1 and 38.2 of high pressure switch 38 are coupled to control unit 4 so that switch 38 can be directly tested.

Terminal 38.2 of high pressure switch 38 is coupled to high terminal 20.2 of gas valve 20 so that the high heat level of gas flow can be activated. When switches 28, 32, and 34 are closed and the pressure inside combustion chamber 14 reaches a predetermined level, high pressure switch 38 closes and forms a closed circuit from control voltage primary 30 to high terminal 20.2 of gas valve 20, from return terminal 20.3 which is coupled to control secondary voltage 40.

Another temperature sensor, rollout switch 42, is located adjacent to combustion chamber 14 for detecting the presence of a flame beyond the expected area of combustion. Rollout switch 42 is coupled at both terminals 42.1 and 42.2 to control unit 4, so that control unit 4 can directly test switch 42. Although not shown, rollout switch 42 can also be coupled in series with high limit switch 28 and flue limit switch 32 to provide an additional safety check in furnace 2. Normally closed, rollout switch 42 opens when a flame is sensed. Although rollout switch 42 closes when no flame is sensed, control unit 4 requires a manual reset at the thermostat before furnace 2 is enabled to operate.

Motor fault switch 58 is coupled with control unit 4 and may provide a signal indicating the existence of a motor fault condition in the motor of circulator fan 10. The motor fault condition disables circulator fan 10, thus greatly reducing the amount of air passing over heat exchanger 8. With circulator fan 10 disabled, the temperature of heat exchanger 8 will rise during operation of burner 16 until high limit switch 28 or flue limit switch 32 turns off burner 16. Also, rollout switch 42 may cause control unit 4 to turn off burner 16.

In addition to being coupled to the temperature and pressure sensors, control unit 4 is coupled to ignitor 24 and flame sensor 26 for regulating combustion in furnace 2. Inducer high line 44 and inducer low line 46 also couple control unit 4 to inducer fan 18 so that two different speed levels can be activated, a high heat speed and a low heat speed, respectively. Circulator high heat line 48, circulator low heat line 50, circulator low cool line 52, circulator high cool line 54, and circulator fan line 56 couple control unit 4 to circulator fan 10 so that five different speed levels can be activated, a high heat speed setting, a low heat speed setting, a low cool speed setting, a high cool speed setting, and a continuous fan setting.

Control unit 4 is also coupled to thermostat 60 in a conventional manner to receive signals indicating if a call for low heat, high heat, or cool is present. For a call for cool, control unit 4 operates circulator fan 10 to direct air through compressor coils (not shown), and operates furnace 2 to end the heating cycle, while thermostat 60 controls air cooling equipment (not shown) to lower the temperature of indoor air 12. The thermostat must be able to communicate the need for high and low heat so that the appropriate stage of heat can be provided by furnace 2. Also, furnace 2 accommodates a fan only signal that indicates circulator fan 10 should be enabled at a fan speed setting without heating plenum 6. Further, a call for cool should be ascertainable from thermostat 60 because operation of furnace 2 can differ when thermostat 60 changes from heat to off or heat to cool.

LED 62 is coupled to control unit 4 which sets LED 62 to flash a predetermined number of times thus indicating various fault conditions in furnace 2. At power-up, LED 62 flashes once. Thereafter, control unit 4 flashes LED 62 continuously when a flame is indicated by flame sensor 26, or turns on LED 62 continuously to indicate a failure in control unit 4. For other fault conditions, control unit 4 sets LED 62 to flash a certain number of times so that LED 62 activates for approximately 0.25 seconds, then pauses for approximately 0.25 seconds before flashing again. Each group of flashes is separated by approximately 2 seconds.

Figure 2:
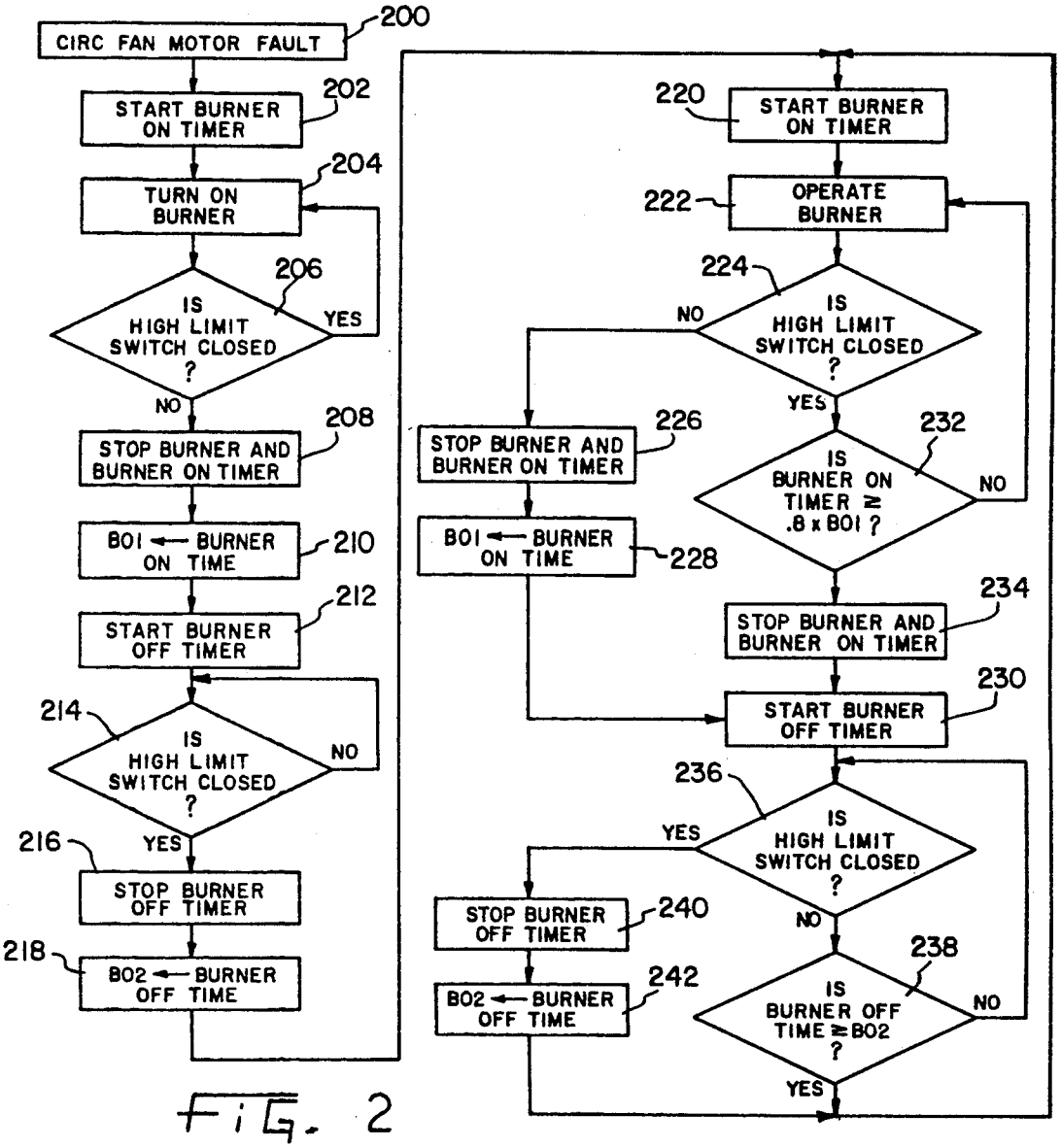
FIG. 2 is a flow chart diagram of the circulator fan motor fault method of the present invention.

In accordance with the present invention, control unit 4 includes programming which causes furnace 2 to operate generally according to the steps shown in the flow chart of FIG. 2. The programming for the operations described below may be stored in non-volatile memory 4.2 to assure than a momentary power interruption does not erase the system programming.

Assuming a demand for heat exists and the circulator fan motor fault is observed, the furnace starts operation of Circ Fan Motor Fault procedure 200. The first step is Start Burner On Timer 202 in which processor 4.1 starts timer 4.4 in order to measure the amount of time gas burner 16 operates until high limit switch 28 opens and halts operation. Shortly thereafter, Turn On Burner step 204 is performed to start the heating of heat exchanger 8. In a two stage or variable rate furnace, a low heating operation is performed regardless of the thermostat heat demand during a circulation motor fault condition. After starting burner 16, control unit 4 cycles through step 206 (Is High Limit Switch Closed?) in which processor 4.1 determines the state of high limit switch 28. Control loops back to step 204 as long as high limit switch 28 is closed. However, upon the opening of high limit switch 28, processor 4.1 stops timer 4.4 and control unit 4 halts the operation of burner 16 in step 208, Stop Burner And Burner On Timer.

At this point, the amount of time required to heat up and open high limit switch 28 is recorded by timer 4.4, and that value is stored to variable BO1 in volatile memory 4.3 during step 210, BO1←Burner On Time. Next, the amount of time required to cool and close high limit switch 28 is determined by starting timer 4.4 in step 212, Start Burner Off Timer. Step 214, Is High Limit Switch Closed?, repetitively checks the status of the high limit switch 28. Control loops back to step 214 as long as high limit switch 28 remains opened. However, upon the closing of high limit switch 28, processor 4.1 stops timer 4.4 in step 216, Stop Burner Off Timer. At this point, the amount of time required to cool and close high limit switch 28 is recorded by timer 4.4, and that value is stored to variable BO2 in volatile memory 4.3 during step 218, BO2←Burner Off Time. With the values of BO1 and BO2 determined and recorded, furnace 2 may be operated to cycle through a heating cycle for only a fraction of the ramping time of heat exchanger 8, thus minimizing heat exchanger damage, as described below in reference to steps 220–242.

First, timer 4.4 is started in step 220, Start Burner On Timer, and burner 16 is started in Operate Burner step 222. Processor 4.1 next determines the state of high limit switch 28 in step 224, Is High Limit Switch Closed?. If not closed, processor stops burner 16 and timer 4.4 in step 226, Stop Burner And Burner On Timer, and the a new burner on time is recorded by timer 4.4, that value is stored to variable BO2 in volatile memory 4.3 during step 228, BO1←Burner On Time. The cool down portion of the cycle then starts at step 230, Start Burner Off Timer.

If processor 4.1 determines high limit switch 28 is still closed in step 224, then processor 4.1 determines whether the current value of timer 4.4 (now functioning as the burner on timer) is greater than or equal to a predetermined value of BO1, for example eight tenths (0.8) of BO1. If the burner on timer is not greater then the predetermined fraction of BO1, then control loops back to step 222. However, if the burner on timer equals or exceeds the predetermined fraction of BO1 in step 232, Is Burner On Timer≧0.8 * BO1?, then the burner on timer and burner 16 are stopped in step 234, Stop Burner And Burner On Timer, and the cool down portion of the cycle then starts at step 230, Start Burner Off Timer.

The fraction of BO1 used in step 232 may be simply a constant value, or may be a value which a function of one or more parameters, for example plenum temperature, fuel type, input rate, and the heat exchanger material. For purposes of the present invention, the fraction used may be any value less than one, although a particular furnace arrangement may have an optimal value. Further, the fraction may be a function of variables which are observed and calculated during operation of the furnace.

After step 230, burner 16 is allowed to cool for the amount of time recorded in variable BO2 or until high limit switch 28 opens. First, processor 4.1 tests high limit switch 28 in step 236, Is High Limit Switch Closed?. If switch 28 remains open then processor 4.1 determines whether timer 4.4 (now functioning as the burner off timer) equals or exceeds BO2, the previously recorded burner off time, in step 238, Is Burner Off Time≧BO2?. If the timer does not equal or exceed the recorded value of BO2, then control loops back to step 236. If the timer exceeds the recorded value of BO2, then control loops back to step 220. In the case where high limit switch 28 cools sufficiently to close before timer 4.4 exceeds BO2, processor 4.1 stops timer 4.4 in step 240, Stop Burner Off Timer, and records the value of timer 4.4 as the new burner off time in step 242, BO2←Burner Off Time.

One embodiment of the present invention, which is compatible with the furnace of the aforementioned U.S. Pat. Nos. 4,976,459, 4,982,721, and 5,027,789, operates according to the process shown in the flow charts of FIGS. 3–6, which provides a specific implementation to the more general example of FIG. 2. Heat step 300 includes any plenum purging, ignitor start-up, and heat exchanger warm up period necessary for proper initiation of a heating cycle, and also includes determining if a call for heating exists. Any existing heat demand causes control unit 4 to determine whether furnace 2 operates on high heating mode, step 302—High Heat, or on low heating mode, step 304—Low Heat. If control unit 4 determines that no heat demand exists then furnace 2 may operate in a fan only or a cooling mode as described in the aforementioned U.S. Patents, or may remain inoperative.

Assuming heat demand exists, processor 4.1 determines whether the low fault flag is set in step 306, Low Fault Flag On?. If the low fault flag is on, then high heating mode is required and control proceeds to High Heat step 302. If not, the high fault flag is checked in step 308, High Fault Flag On?. If the high fault flag is on then control proceeds to checking step 314, Check Heat Delay, Rollout, High Limit, Cool, Heat, Low Pressure Switch. If the high fault flag is not set then the motor fault flag is checked in step 310, Motor Fault Flag Set?. With the motor fault flag set, control proceeds to Low Heat step 304. After determining the motor fault flag is not set then control unit 4 determines if a call for high heat exists in step 312, Call For High Heat?. If a call for high heat exists, then control proceeds to High Heat step 302, otherwise control proceeds to checking step 314.

Figure 3:
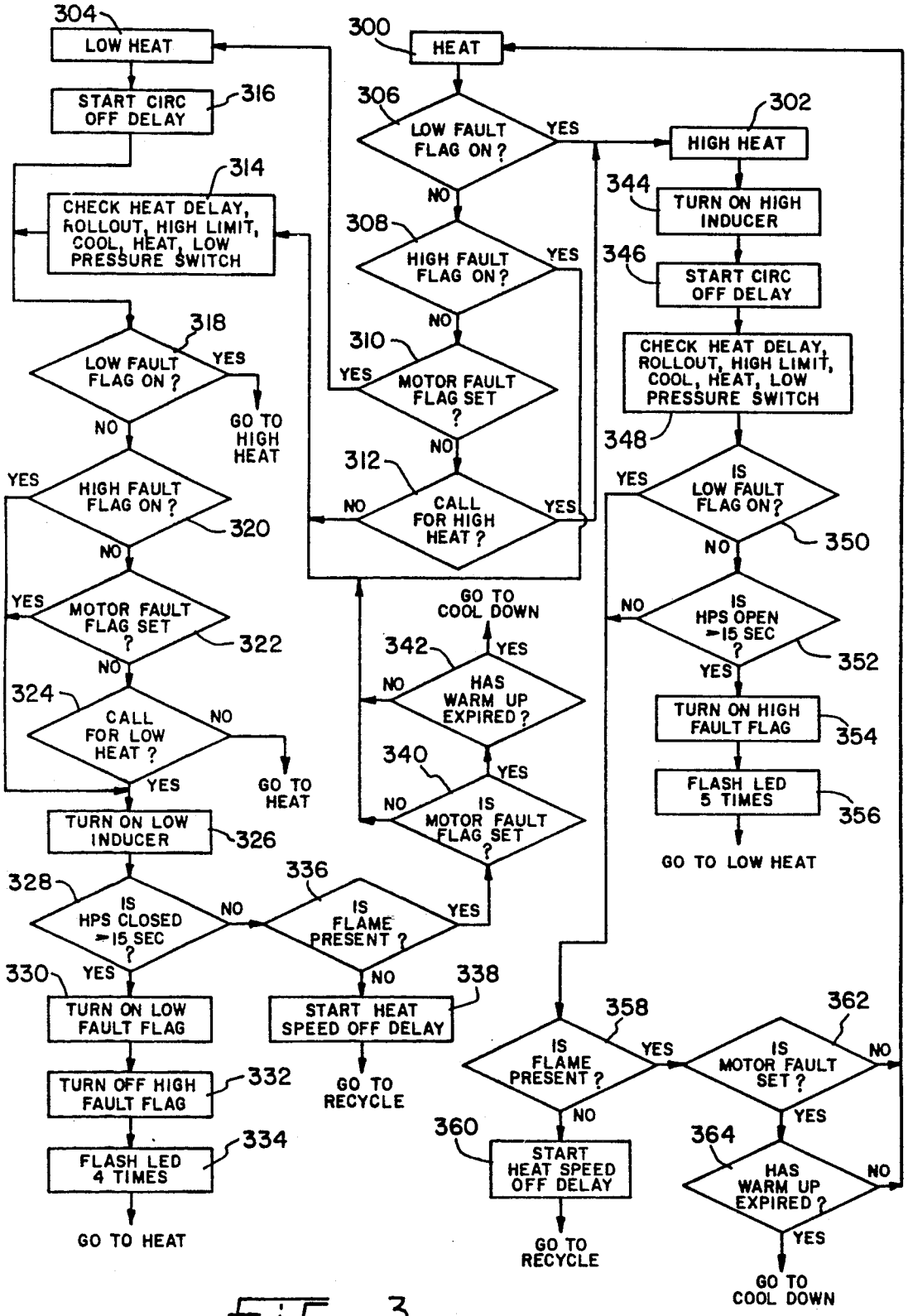
FIG. 3 is a flow chart diagram of a portion of the heat cycle implementing the circulator fan motor fault routine.

The low heating mode routine of furnace 2 operates according to steps 304 and 314–342 of FIG. 3. One entry point into the low heating mode routine is Low Heat step 304, which is followed by step 316, Start Circ Off Delay, wherein the circulator fan delay procedure is enabled. The other entry point into the low heating mode routine is checking step 314. The step following Start Circ Off Delay step 316 and checking step 314 is where processor 4.1 determines whether the low fault flag is on, namely step 318, Low Fault Flag On. If the low fault flag is on, then control proceeds to High Heat step 302. With the low fault flag off, processor 4.1 next determines whether the high fault flag is on in step 320, High Fault Flag On?. With the high fault flag being off, processor 4.1 then determines if the motor fault flag is set in step 322, Motor Fault Flag Set?. With the motor fault flag not being set, control unit 4 then determines if a call for low heat exists in step 324, Call For Low Heat. If a call for low heat does not exist, then control proceeds to High Heat step 302. However, if the high fault flag is on during step 320, or if the motor fault flag is set during step 322, or if a call for low heat exists in step 324, control proceeds to step 326, Turn On Low Inducer. At this point, heating may begin by operation of burner 16 because inducer fan 18 now provides air for combustion. If step 326 occurs while inducer 18 is already running, there is no additional effect.

After turning on inducer fan 18, high pressure switch 38 is checked to see if it has been closed for 15 seconds in step 328, Is HPS Closed>15 Sec?. If high pressure switch 38 has been closed for 15 seconds, then the low fault flag is turned on in step 330, Turn On Low Fault Flag, the high fault flag is turned off in step 322, Turn Off High Fault Flag, LED 62 is set to flash 4 times in step 334, Flash LED 4 Times, and control proceeds to Heat step 300.

After determining that high pressure switch 38 has not been closed for more than 15 seconds in step 328, control unit 4 then determines if a flame is present in step 336, Is Flame Present?. If control unit 4 determines that no flame exists then the heat speed off delay procedure is started at step 338, Start Heat Speed Off Delay, and control proceeds to a recycle procedure which allows up to 255 attempts to keep the flame lit. The recycle procedure is described in more detail in the aforementioned U.S. Patents.

After determining that a flame is present in step 336, processor 4.1 determines whether the motor fault flag is set in step 340, Is Motor Fault Flag Set?. If the motor fault flag is not set, then control loops back to checking step 314. If the motor fault flag is set, then processor 4.1 determines if the warm up time has expired in step 342, Has Warm Up Expired?. The warm up time is the fraction of the total amount of time required to open high limit switch 28, for example 80%. If the warm up timer has not expired, then control loops back to checking step 314. However, if the warm up time has expired in step 342, control proceeds to the COOL DOWN routine described below in reference to FIG. 5.

The high heating mode routine of furnace 2 operates according to steps 302, 344–360 of FIG. 3. Following High Heat step 302, control unit 4 turns inducer 18 on high in step 344, Turn On High Inducer, initiates the circulator fan off delay procedure in step 346, Start Circ Off Delay, and performs checking step 348, Check Heat Delay, Rollout, High Limit, Cool, Heat, Low Pressure Switch. After checking step 346, processor 4.1 determines if the low fault flag is on in step 350, Is Low Fault Flag On?.

When the low fault flag is not on in step 350, processor 4.1 checks high pressure switch 38 to see if it has been open for more than 15 seconds in step 352, Is HPS Open>15 Sec?. If high pressure switch 38 has been open for more than 15 seconds, the high fault flag is turned on in step 354, Turn On High Fault Flag, LED 62 is set to flash 5 times in step 356, Flash LED 5 Times, and control proceeds to Low Heat step 304.

After determining that high pressure switch 38 has not been closed for more than 15 seconds in step 328, or if the low fault flag is on during step 350, control unit 4 then determines if a flame is present in step 358, Is Flame Present?. If control unit 4 determines that no flame exists then the heat speed off delay procedure is started at step 360, Start Heat Speed Off Delay, and control proceeds to the recycle procedure.

After determining that a flame is present in step 358, processor 4.1 determines whether the motor fault flag is set in step 362, Is Motor Fault Flag Set?. If the motor fault flag is not set, then control loops back to High Heat step 302. If the motor fault flag is set, then processor 4.1 determines if the warm up time has expired in step 364, Has Warm Up Expired?. If the warm up timer has not expired, then control loops back to High Heat step 302. However, if the warm up time has expired in step 364, control proceeds to the COOL DOWN routine described below in reference to FIG. 5.

Figure 5:
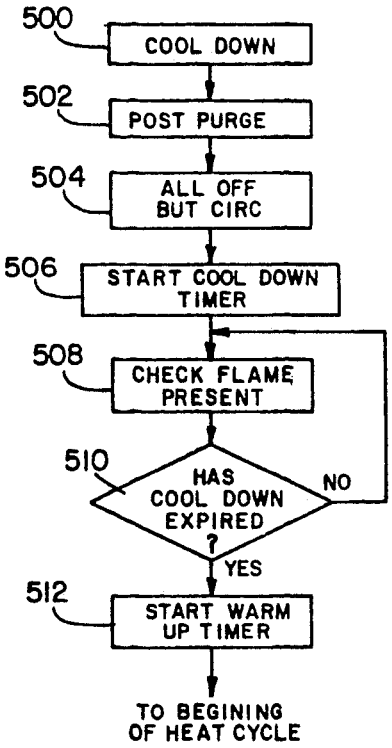
FIG. 5 is a flow chart diagram of the cool down routine implementing the circulator motor fan fault routine.

The COOL DOWN routine is depicted in the flow chart of FIG. 5. The entry point to the COOL DOWN routine is step 500, Cool Down. The next step is Post Purge step 502 wherein inducer 18 is turned on high speed for a predetermined period of time, for example 15 seconds, and certain fault conditions are checked for. One example of a compatible post purge routine is provided in the aforementioned U.S. Patents. However, in the present invention control returns to the calling routine, here the COOL DOWN routine, after expiration of the 15 second timer. Following post purge step 502, control unit 4 turns off all of furnace 2 except for circulator fan 10 in step 504, All Off But Circ. In the next step 506, Cool Down Timer←Cool Down, timer 4.4 is set to the recorded cool down time (described below in connection with the HIGH LIMIT routine) and counts backward from that value. After setting the cool down timer, flame is checked for in step 508, Check Flame Present. Control unit 4 next determines if the cool down timer has expired in step 510, Has Cool Down Expired?. If the cool down timer has not expired in step 510, control loops back to step 508, but if the cool down timer has expired then the warm up timer is set to the recorded warm up time value in step 512, Start Warm Up Timer, and the heating cycle is restarted at High Heat step 300.

Figure 6:
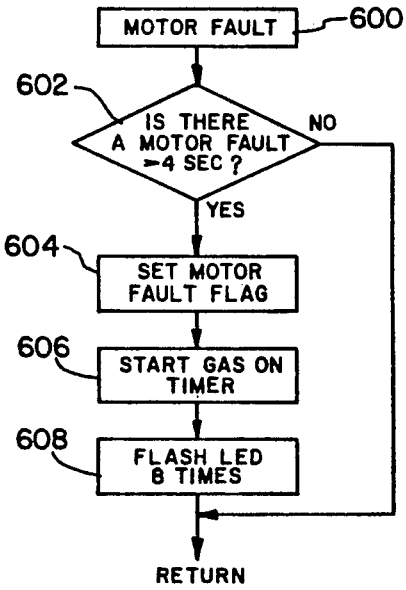
FIG. 6 is a flow chart diagram of the circulator fan motor fault routine.

The MOTOR FAULT routine of the aforementioned U.S. Patents is modified to accommodate the present invention. A flow chart depicting the MOTOR FAULT routine of the present invention is shown in FIG. 6. The entry point for the MOTOR FAULT routine is step 500, Motor Fault, after which control unit 4 determines if a motor fault is indicated by motor fault switch 58 for more than a transitory amount of time, for example 4 seconds, in step 602, Is There A Motor Fault>4 Sec?. Assuming a motor fault is not detected for more than the aforesaid amount of time, then control RETURNs to the portion of program in which the MOTOR FAULT routine was called. However, if motor fault switch 58 indicates a motor fault for more than 4 seconds, then processor 4.1 sets the motor fault flag in step 604, Set Motor Fault Flag, starts timer 4.4 as a gas on timer in step 606, Start Gas On Timer, causes LED 62 to flash 8 times in step 608, Flash LED 8 Times, before RETURNing to the calling routine. Thus, the motor fault flag is set, timer 4.4 is started to measure the amount of time required to cause high limit switch 28 to open (see the description of the HIGH LIMIT routine of FIG. 4 below), and LED 62 is set to display the motor fault condition.

Figure 4:
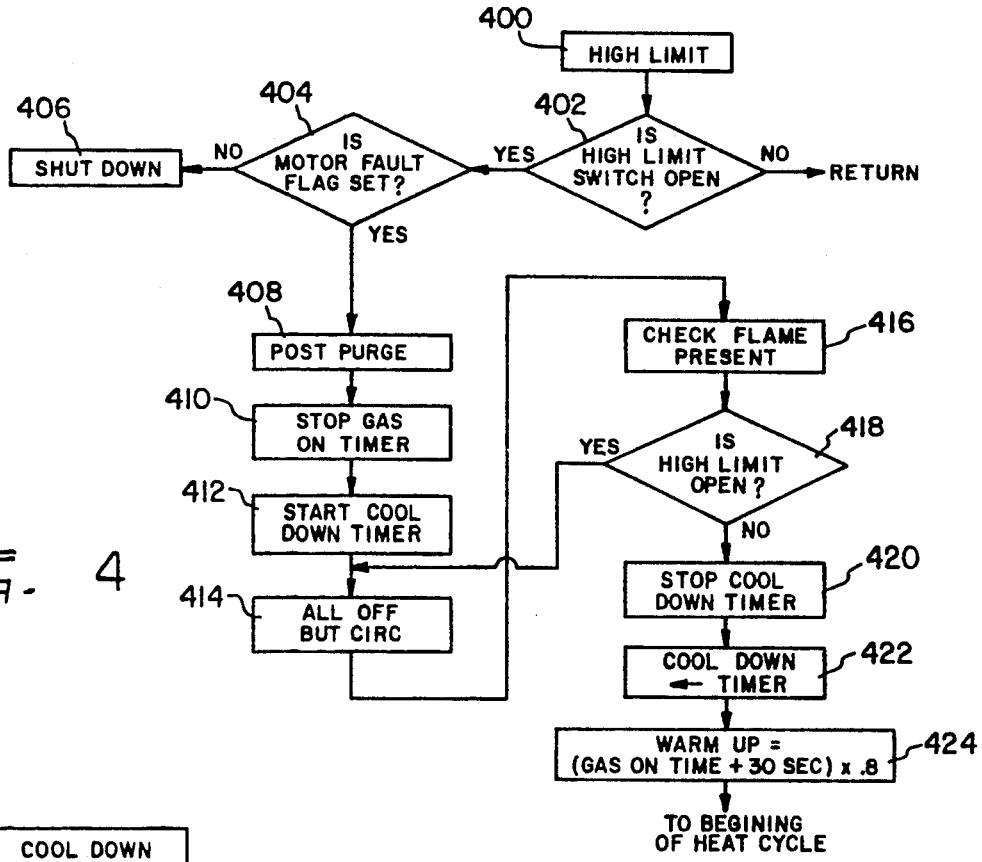
FIG. 4 is a flow chart diagram of the high limit switch routine implementing the circulator motor fan fault routine.

The HIGH LIMIT routine of the aforementioned U.S. Patents is modified to accommodate the present invention. A flow chart depicting the HIGH LIMIT routine of the present invention is shown in FIG. 4. The entry point is High Limit step 400, which is followed by processor 4.1 determining if high limit switch 28 is open in step 402, Is High Limit Switch Open?. If not open, control RETURNs to the calling routine. If high limit switch 28 is open, then processor 4.1 determines if the motor fault flag is set in step 404, Is Motor Fault Flag Set?. In the case where the motor fault flag is not set, control proceeds to step 406, Shut Down, wherein control unit 4 terminates the current heating cycle in a manner described in more detail in the aforementioned U.S. Patents. However, if the motor fault flag is set, indicating a failure of the motor of circulator fan 10, then control unit 4 operates furnace 2 according to steps 408–422 described below.

Post Purge step 408 is similar to the previously described Post Purge step 502. After the post purge operation, the gas on timer (originally started in the motor fault routine) is stopped in step 410, Stop Gas On Timer. Stopping the gas on timer provides a measurement of the amount of time required to operate burner 16 and open high limit switch 28 when circulator fan 10 is inoperative. Next, timer 4.4 is activated to determine the cool down time in step 412, Start Cool Down Timer. After activating the cool down timer, all but circulator fan 10 of furnace 2 are deactivated in step 414, All Off But Circ. Following step 414, flame is checked for in step 416, Check Flame Present, followed by processor 4.1 determining if high limit switch 28 is open in step 418, Is High Limit Open?. If high limit switch 28 is open during step 418, then control loops back to step 414. Once high limit switch 28 cools sufficiently to be closed during step 418, processor 4.1 stops the cool down timer in step 420, Stop Cool Down Timer, sets the value of the cool down variable equal to the elapsed time in step 422, Cool 30 Down←Timer, sets the value of the warm up variable to eighty percent (80%) of the sum of the gas on time and 30 additional seconds in step 424, Warm Up←(Gas On Time+30 Sec)×0.8, and finally resumes operation with Heat step 300.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A furnace comprising:

a plenum including a heat exchanger and burner means for heating said heat exchanger;

circulator means for circulating indoor air about said heat exchanger, said circulator means being in communication with said plenum, said circulator means including fault means for indicating a circulator fault condition;

control means for activating and deactivating said burner means, said control means operating said burner means for a first time period and disabling said burner means for a second time period when said fault means indicates said circulator fault condition, whereby upon indication of said circulator fault condition by said fault means, said control means alternately operates and disables said burner means.

2. The furnace of claim 1 further comprising high limit means for sensing a high plenum temperature and indicating the sensing of said high plenum temperature to said control means, said control means determining said first time period according to a measured time period in which continuous operation of said burner means activates said high limit means.

3. The furnace of claim 2 wherein said control means determines said first time period as a fraction of said measured time period.

4. The furnace of claim 3 wherein said control means further includes timer means for determining said first and second time periods by timing the activation and deactivation of said high limit means.

5. The furnace of claim 4 wherein said timer means measures the time period said control means operates said burner means, and if said high limit means indicates said high plenum temperature before the end of said fraction of said first time period then said control means resets said first time period to said measured time period.

6. The furnace of claim 4 wherein said timer means measures a second amount of time said high limit means indicates said high plenum temperature after operation of said burner means ceases, and if said second measured amount of time exceeds said second time period then said control means resets said second time period to equal said second measured amount of time.

7. The furnace of claim 1 wherein said burner means is adapted to provide low and high levels of heating, said control means operating said burner means to provide the low level of heating when said fault means indicates said circulator fault condition.

8. The furnace of claim 3 wherein said control means operates said burner means for about eighty percent (80%) of said first time period.

9. The furnace of claim 3 wherein said control means calculates said fraction of said first time period according to variables including plenum temperature, fuel type, input rate, and heat exchanger material.

10. A furnace comprising:

a plenum including a heat exchanger, burner means for heating said heat exchanger, and high limit means for sensing a predetermined high plenum temperature;

circulator means for circulating indoor air about said heat exchanger, said circulator means in communication with said plenum, said circulator means including fault means for indicating a circulator fault condition;

control means for activating and deactivating said burner means, and upon indication of said circulator fault condition by said fault means, said control means operates said burner means for a first time period until said high limit means indicates said high plenum temperature, then said control means disables said burner means for a second time period until said high limit means indicates said plenum is not at said high plenum temperature, and said control means then alternately operates said burner means for a fraction of said first time period and then disables said burner means for said second time period whereby said furnace provides heating and limits the thermal stress on said heat exchanger.

11. The furnace of claim 10 wherein said control means further includes timer means for determining said first and second time periods by timing the activation and deactivation of said high limit means.

12. The furnace of claim 11 wherein said timer means measures the amount of time said control means operates said burner means, and if said high limit means indicates said high plenum temperature before the end of said fraction of said first time period then said control means resets said first time period to a fraction of said measured amount of time.

13. The furnace of claim 11 wherein said timer means measures the amount of time said high limit means indicates said high plenum temperature after operation of said burner means ceases, and if said measured amount of time exceeds said second time period then said control means resets said second time period to said measured amount of time.

14. The furnace of claim 10 wherein said burner means is adapted to provide low and high levels of heating, said control means operating said burner means to provide the low level of heating when said fault means indicates said circulator fault condition.

15. The furnace of claim 10 wherein said control means operates said burner means for about eighty percent (80%) of said first time period.

16. The furnace of claim 10 wherein said control means calculates said fraction of said first time period according to variables including plenum temperature, fuel type, input rate, and heat exchanger material.

17. A method of operating a furnace, the furnace including a heating element, a heat exchanger, a circulator fan, and a control unit, said method comprising the steps of:

providing a high temperature indicating device which indicates when the heat exchanger exceeds a predetermined temperature;

providing a fault indicating device which indicates when the circulator fan has a fault condition;

operating the heating element to warm the heat exchanger;

sensing a motor fault condition and measuring a first time period in which the heating element warms the heat exchanger;

alternately disabling the heating element to allow the heat exchanger to cool and operating the heating element for said first time period to heat the heat exchanger.

18. The method of claim 17 further including a step after said first time period measuring comprising of measuring a second time period in which the heat exchanger cools after operation of the heating element ceases.

19. The method of claim 18 wherein said disabling step occurs for said second time period.

20. A method of operating a furnace during a circulator fault condition, the furnace including a heat exchanger which may be heated to a predetermined high plenum temperature by a burner, said method comprising the steps of:

measuring a first time period required to heat the heat exchanger to the high plenum temperature;

measuring a second time period required to allow the heat exchanger to dissipate the high plenum temperature; and operating the burner for said first time period; and disabling the burner for said second time period.

21. The method of claim 20 wherein said operating step includes operating the burner for a fraction of said first time period.

22. The method of claim 21 wherein said fraction of said first time period comprises about eighty percent (80%) of said first amount of time.

23. The method of claim 21 wherein said fraction of said first time period is calculated according to variables including plenum temperature, fuel type, input rate, and heat exchanger material.

24. The method of claim 20 further comprising alternately and repetitively performing said operating and disabling steps after measuring said first and second time periods.

* * * * *